US005816930A

United States Patent [19]

Brown

[11] Patent Number: 5,816,930

[45] Date of Patent: Oct. 6, 1998

[54] GOLF PUTTER HEAD

[76] Inventor: Jon R. Brown, 807 Serenade, Richardson, Tex. 75081

[21] Appl. No.: 806,634

[22] Filed: Feb. 26, 1997

[51] Int. Cl.[6] ..... A63B 69/36

[52] U.S. Cl. ..... 473/254; 473/340; 473/341; 473/350

[58] Field of Search ..... 473/253, 254, 473/340, 341, 350

[56] References Cited

U.S. PATENT DOCUMENTS

| | | | |
|---|---|---|---|
| 3,085,804 | 4/1963 | Pieper | 273/168 |
| 3,880,430 | 4/1975 | McCabe | 273/183 D |
| 4,032,156 | 6/1977 | Clarke | 473/253 |
| 4,043,562 | 8/1977 | Shillington | 273/164.1 |
| 4,077,633 | 3/1978 | Studen | 273/164.1 |
| 4,136,877 | 1/1979 | Antonious | 273/183 D |
| 4,231,576 | 11/1980 | Perkins | 273/187.4 |
| 4,458,900 | 7/1984 | Antonious | 273/187.4 X |
| 4,629,193 | 12/1986 | Pierman | 273/187.4 X |
| 4,986,544 | 1/1991 | Benson | 473/254 |
| 5,248,145 | 9/1993 | Brown | 273/187.4 |

FOREIGN PATENT DOCUMENTS

| | | | |
|---|---|---|---|
| 2142248 | 1/1985 | United Kingdom | A63B 53/04 |

OTHER PUBLICATIONS

Ram Golf Corp. Advertisement for Zebra Putter, in Business Week, Dec. 16, 1996.

Ram Golf Corp. World Wide Web page for Zebra Putter http://www.ramgolf.com/inszeb.htm.

Advertisement for "Optimum Balance Putter Head", believed to be approximately 1992.

Spotline Golf advertisement, copyrighted 1992.

*Primary Examiner*—George J. Marlo

*Attorney, Agent, or Firm*—W. Thomas Timmons; Timmons & Kelly

[57] ABSTRACT

A golf club head (H) having a head body (10) adapted to be secured to a club shaft (12) includes a first vertically oriented surface (14) that defines a ball striking face containing a sweet spot (16) thereon. A first sighting indicia (42) has a plurality of stepped surfaces (46) having an elongated longitudinal axis (52) extending parallel to the first vertically oriented surface (14). A second sighting indicia (44) has an elongated slender stripe (54) having a longitudinal axis (56) perpendicular to the elongated longitudinal axis (52) of the stepped surfaces (46) and intersecting the sweet spot (16). The first and second sighting indicia (42, 44) enable a user 58) of the club to visually align the sweet spot (16) of the first vertically oriented surface (14) relative to a golf ball (B) to be struck and a desired direction of travel 28) for the golfball (B).

6 Claims, 3 Drawing Sheets

GOLF PUTTER HEAD

SPECIFICATION

BACKGROUND OF THE INVENTION

1. Technical Field

The invention relates to the field of golf clubs and more particularly to the head or ball striking portion of golf clubs.

2. Background Art

Golf clubs and the head portions of golf clubs are well known in the art and have many designs to achieve different purposes. Typical of golf clubs is a type of club called a putter and the type of stroke at the golf ball called a putter.

A golfer will normally set the putter head behind the golf ball such that the face of the putter head is square to the intended line or stroke or roll of the golf ball. The golfer will swing the putter club back to a predetermined distance along an extension of the golf ball's intended line of roll. Finally, the golfer will swing the putter head forward such that the face of the putter head strikes the golf ball thereby imparting momentum and propelling the ball forward.

The length of the back swing and the force associated with the swinging of the putter head forward to strike the golfball will be dictated by the distance to be traversed by the golfball in its travel toward the cup and the slope of the putting surface along the intended line of roll. It will be appreciated that the shorter the distance of the back swing and the less force needed to be applied to the putter during the forward swinging of the putter head for a given distance to the cup the better the probability that the face of the putter head will remain square to the extension of the intended line of roll of the golf ball and that the "sweet spot," or the desired point of contact between the striking face of the golf club head and the ball, will remain directly above the extension.

Additionally, various sighting alignment devices have been disclosed to help the golfer in pre-alignment of the golf club.

An example of a putter head for a golf club is U.S. Pat. No. 5,248,145 and other references cited therein.

It is also known to include two or more weights units inserted in the club body behind of forming the club face when joined by a cross piece. Additionally, club face inserts are also known in the golf club or putter club related art, but such clubs do not include weights or masses extending or positioned behind the club face.

While the above cited references introduce and disclose a number of noteworthy advances and technological improvements within the art, none completely fulfills the specific objectives achieved by this invention.

DISCLOSURE OF THE INVENTION

In accordance with the present invention, a golf club head having a head body adapted to be secured to a club shaft includes a first vertically oriented surface that defines a ball striking face containing a sweet spot thereon. At least one weight body has a density greater than the head body and forms an integral weight insert mounted within the head body. The weight body has a first and second weighted mass members with each having a center of mass disposed apart from a preferred stroke direction vector through the sweet spot and the head body. The weight insert has a center of mass aligned with the preferred stroke direction vector to widen the sweet spot.

An alternative design of a golfhead includes a sight alignment device formed with a golf club head. The club head has a head body that is adapted to be secured to a club shaft and includes a first and second sighting indicia. A first vertically oriented surface defining a ball striking face typically contains a sweet spot. The first sighting indicia consists of a plurality of stepped surfaces and supporting bands that connect pairs of the separate levels of the stepped surfaces. The stepped surfaces each have an elongated longitudinal axis that extends parallel to the first vertically oriented surface.

A second sighting indicia consists of an elongated slender stripe that has a longitudinal axis perpendicular to the elongated longitudinal axis of the stepped surfaces. The second sighting indicia intersects the sweet spot of the first vertically oriented surface. The first sighting indicia is also preferably located between the first vertically oriented surface and the second sighting indicia.

The first and second sighting indicia when used together enable a user of the club to visually align the sweet spot of the first vertically oriented surface relative to a golf ball to be struck and a desired direction of travel for the golf ball.

These and other objects, advantages and features of this invention will be apparent from the following description taken with reference to the accompanying drawings, wherein is shown the preferred embodiments of the invention.

Brief Description of Drawings A more particular description of the invention briefly summarized above is available from the exemplary embodiments illustrated in the drawing and discussed in further detail below. Through this reference, it can be seen how the above cited features, as well as others that will become apparent, are obtained and can be understood in detail The drawings nevertheless illustrate only typical, preferred embodiments of the invention and are not to be considered limiting of its scope as the invention may admit to other equally effective embodiments.

MODE(S) FOR CARRYING OUT THE INVENTION

So that the manner in which the above recited features, advantages and objects of the present invention are attained can be understood in detail, more particular description of the invention, briefly summarized above, may be had by reference to the embodiment thereof that is illustrated in the appended drawings. In all the drawings, identical numbers represent the same elements.

Golf Club Head with Weighted Insert

Figure 4:
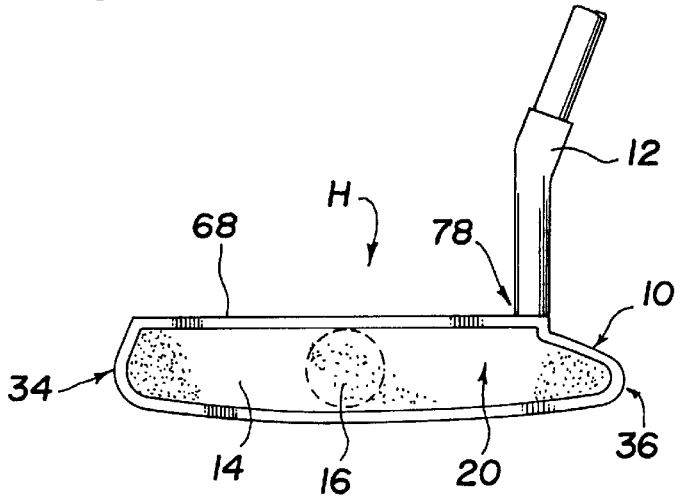
FIG. 4 is a frontal view of the present invention with the weight insert.

A golf club head H having a head body 10 adapted to be secured to a club shaft 12 includes a first vertically oriented surface or club face 14 that defines a ball striking face containing a sweet spot 16 (shown approximately in phantom in FIG. 4) thereon. At least one weight body 18 has a density greater than the remaining portion of the head body 10 and forms an integral weight insert segment 20 mounted within or forming a portion of the exterior of the head body 10.

The weight body 18 preferably has a first and second weighted mass members (22 and 24 respectively) with each mass member having a center of mass 26 that is disposed apart from a preferred stroke direction vector 28 through the sweet spot 16 and the head body 10. The complete weight insert 20 itself has a center of mass 30 aligned with the preferred stroke direction vector 28 to widen or otherwise improve the sweet spot 16.

The weight insert 20 preferably is barbell or U-bar shaped and consists of a dense material, such as beryllium, brass, lead, another metallic material or and other chosen dense material. The U-bar weight insert 20 embodiment includes a central weight segment or bar 32 extending between at least two of the mass members 22 and 24 at either end of the bar 32, for example. The bar 32 may be separate from the mass members 22 and 24, or the bar 32 may be formed with the mass members 22 and 24. The U-bar shaped insert 20 is a unique way to weight a putter that is made of a lighter or less dense material than the remaining portion of the club head H, such as titanium, a plastic, composite material, aluminum or other chosen light and strong material. One selected putter head H composition would include beryllium for the weight insert 20 surrounded and bonded to a titanium shell forming the desired shape for a putter club.

As desired, the weight insert 20 is located in proximity to the first vertically oriented surface 14. Alternatively for a U-bar shaped weight insert 20, the front portion 38 of the central bar 32 and the front portion 40 of the mass members 22 and 24 can form the ball striking area of the club face 14. The remaining portion of the club head body 10 can then be a composite or plastic material molded or otherwise formed around the weight insert in any desired pattern forming the club head body 10.

The one piece arrangement of the U-bar shaped insert 20 adds weight to the toe 34, heel 36 and face 14 of the club H, while also increasing the overall weight of the golf club head H and distributing the weight where it will do the most good. This improves the stability of the club during the stroke of the player. As desired, the mass member 22 closest to the toe 34 of the club may be more massive or heavier than the mass member 24 closest to the heel 36 of the club head H.

Club Head Having Sighting Indicia

In a second and separate embodiment in the present invention, a golf club head H having a head body 10 adapted to be secured to a club shaft 12 includes a first and second sighting indicia (42 and 44 respectively). A first vertically oriented surface 14 defining a ball striking face contains a sweet spot 16 thereon. A first sighting indicia 42 consists of a plurality of stepped surfaces 46 and supporting bands 48 connecting pairs of separate levels 50 of the stepped surfaces 46. The stepped surfaces 46 each have an elongated longitudinal axis 52 that extends parallel to the first vertically oriented surface 14.

A second sighting indicia 44 consists of an elongated slender stripe 54 having a longitudinal axis 56 perpendicular to the elongated longitudinal axis 52 of the stepped surfaces 46. The second sighting indicia 44 intersects the sweet spot 16 of the first vertically oriented surface 14. The first sighting indicia 42 is also preferably located between the first vertically oriented surface 14 and the second sighting indicia 44.

Figure 6:
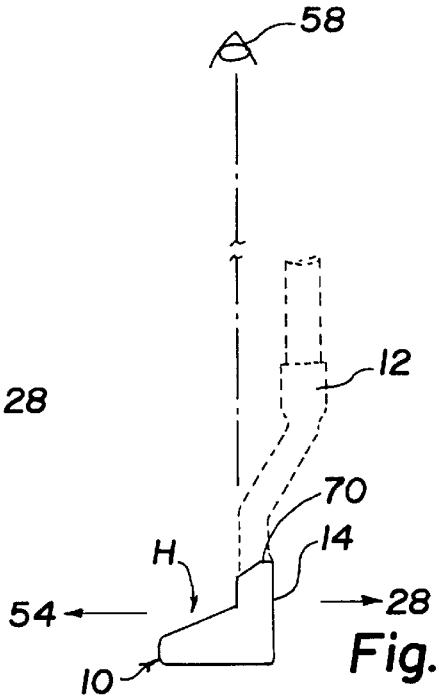
FIG. 6 is a side view of the club head with an observer using the present sighting system.
Figure 7:
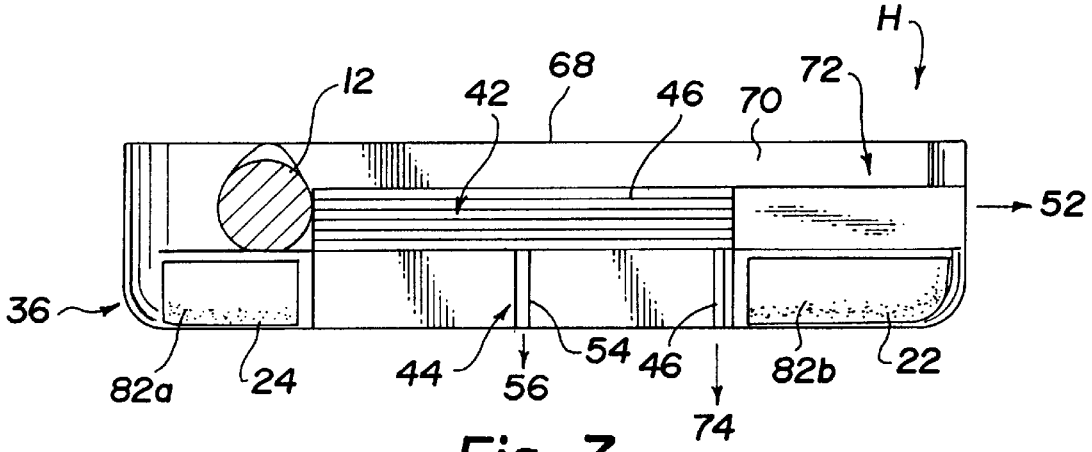
FIG. 7 is a top view of FIG. 1.

The first and second sighting indicia 42 and 44 when used together enable a user 58 of the club H to visually align the sweet spot 16 of the first vertically oriented surface 14 relative to a golf ball B to be struck and a desired direction of travel for the golf ball B. See FIG. 6.

A cavity or hollow 60 may be formed in a backside 62 of the club head body 10 of the club head H. The backside 62 is the side of the club head H that is opposite the club face 14. The stripe 54 can be a groove 64 formed in the backside of the club head H or formed as a painted 66 or otherwise colored different from the surrounding portion of the club head H.

Also, the plurality of the stepped surfaces 46 can descend in levels 50 from an upper edge 68 of the first vertically oriented surface 14 toward the backside 62 of the club head body 10 of the club head H. It is preferred that the first sighting indicia 42 extend only a portion of the backside 62 of the club head body 10 of the club head H.

Figure 1:
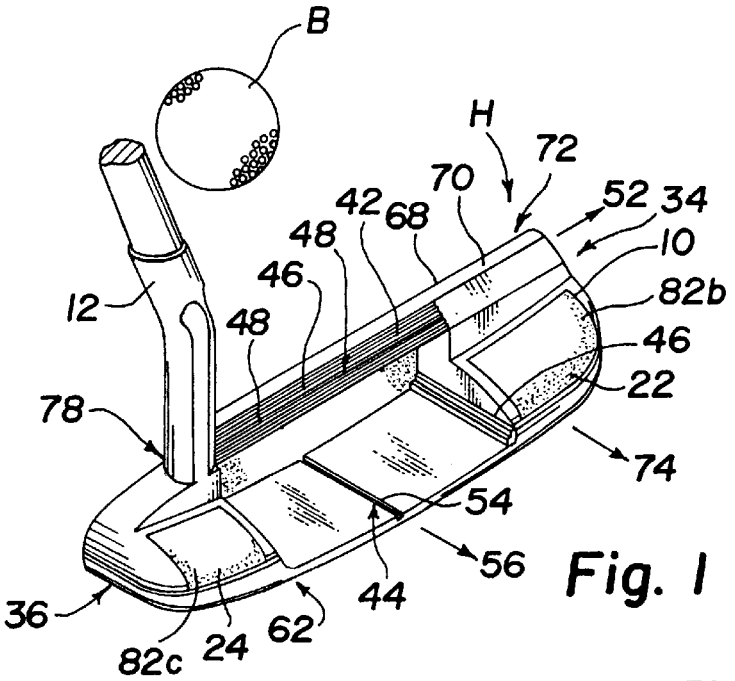
FIG. 1 is a perspective view of one embodiment of a golf club head including the present sighting invention including parallel sight lines behind the ball striking face.
Figure 1A:
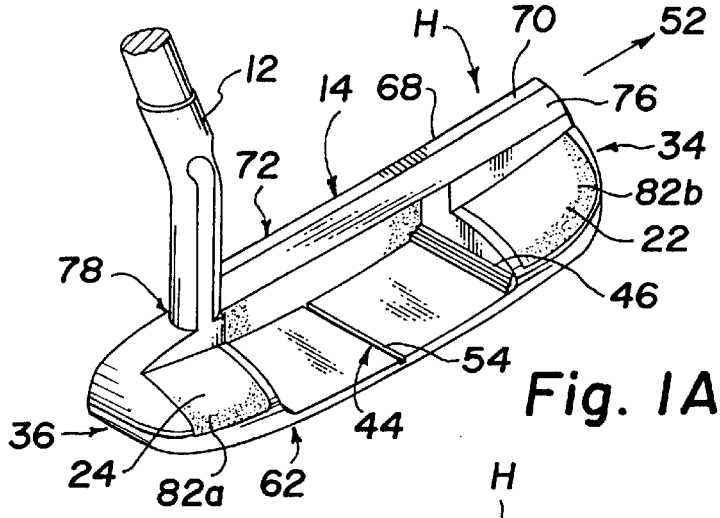
FIG. 1A is another embodiment of the present invention including a sloped segment behind the ball striking face.
Figure 2:
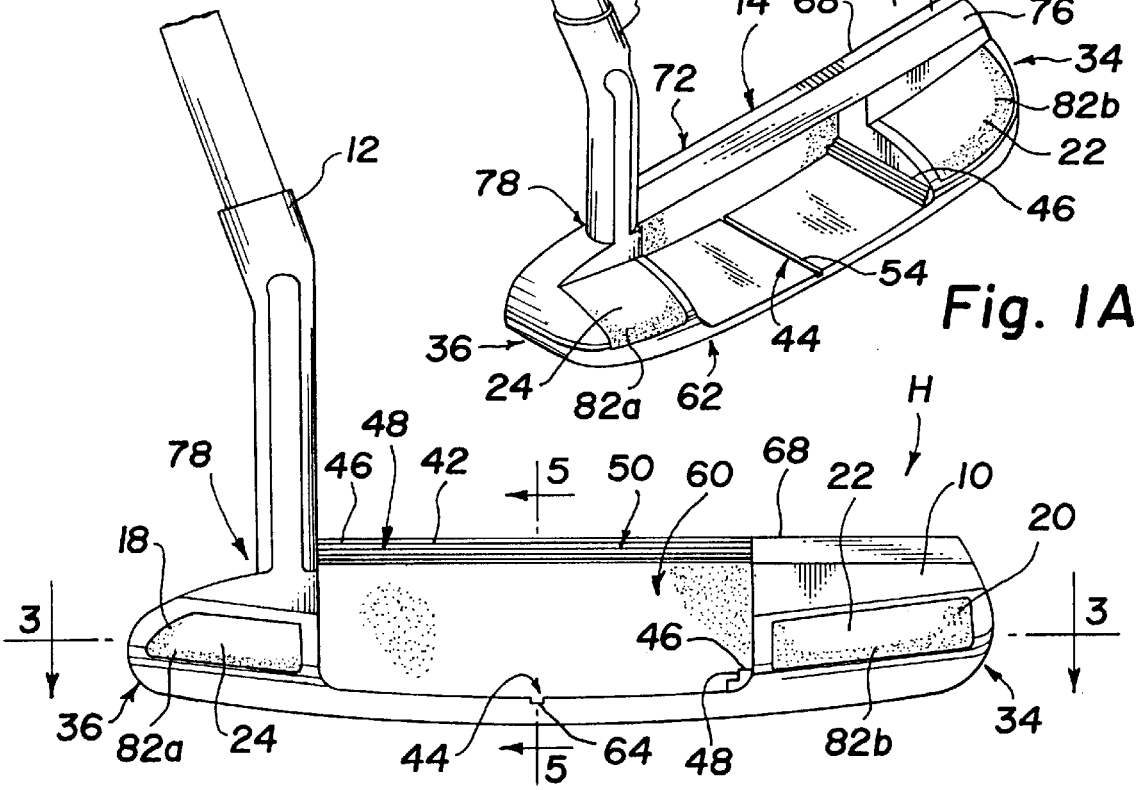
FIG. 2 is an elevational rear view.
Figure 3:
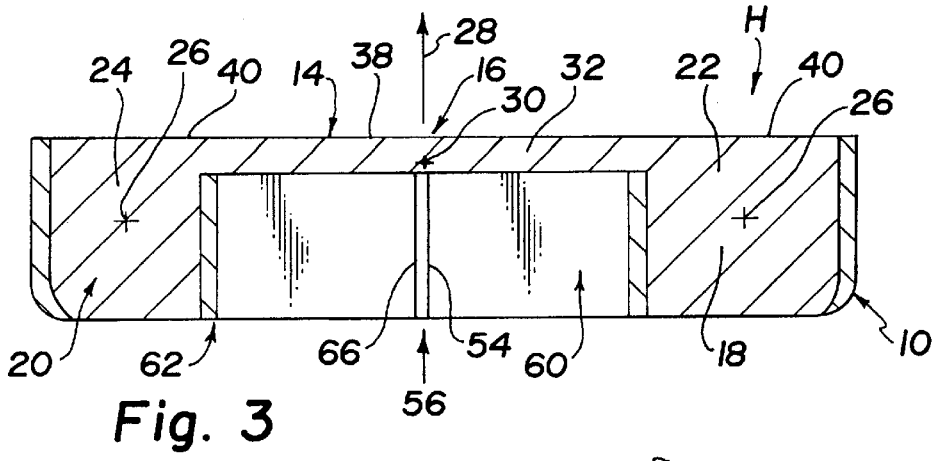
FIG. 3 is a cross sectional view of the present invention with the weight insert taken along line 3—3 of FIG. 2.

Alternatively, the stepped surfaces 46 and connecting bands 48 can be a plurality of grooves formed in a sloped surface, such as shown by element 76 in alternative FIG. 1A, or lines painted on the sloped surface 76.

Figure 5:
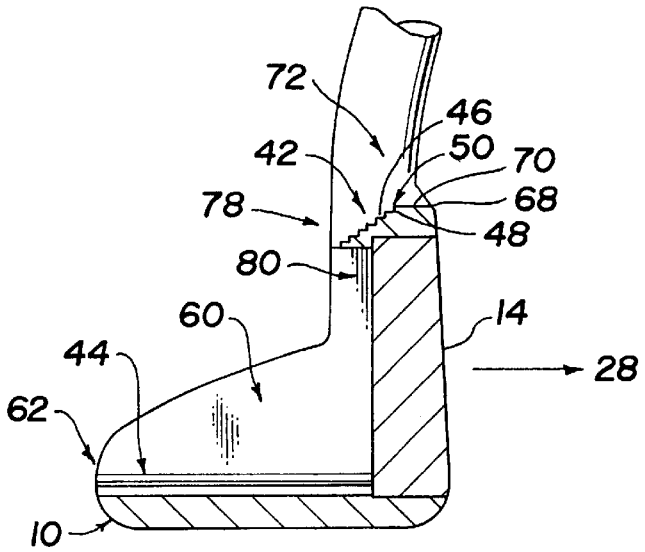
FIG. 5 is a cross sectional view of the golf club head with the weight insert and stair stepped sighting surfaces taken along line 5—5 of FIG. 2.

Referring particularly to FIG. 5, the cavity 60 may optionally extend into the club head H toward, but not reaching, the club face 14 and beneath first sighting indicia 42 with the stepped surfaces 46 or the alternative sloped surface 76, as is generally shown by element number 80 in FIG. 5.

Optionally, stepped surfaces 46 and connecting bands 48 may be formed in the bottom of the cavity 60 and having a longitudinal axis 74 that is parallel to the second sighting indicia 44.

As an example of one arrangement or a series of dimensions for the first sighting indicia 42 includes a flat surface 70 on the top surface 72 of the club head body 10. Each of the stepped surfaces 46 may be a flat surface ⅛ of an inch wide with the bands 48 or drop off between the stepped surfaces 46 being approximately 3/16 of an inch deep and preferably at a non-parallel angle to the club face 14.

In yet another alternative embodiment shown in FIG. 1A, a sloped surface 76 extends downwardly toward the backside 62 from the upper edge 68 and behind the flat surface 70 on the top 72 behind the club face 14. The sloped surface extends from the attachment point 78 of the shaft 12 to the club head H to the toe 34 of the club head H. The sloped surface has an elongated longitudinal axis 52 extending parallel to the first vertically oriented surface 14. Generally, like the stepped surfaces 46, the sloped surface 76 extends only a portion of the backside of the club head 10.

At least one and preferably two colored areas 82*a* and 82*b* on the backside 62 of the club head body 10 and located near the toe 34 and the heel 36 cooperate with the first sighting indicia 42. The two colored areas 82*a*, 82*b* may be formed on an upper surface or the top 72 of the club such that they are visible by the observer 58 when viewed from above. The colored areas 82*a*, 82*b* may be exposed portions of the weight insert 20 that is a different color metallic material from the color of the surrounding portions of the head body 10. Alternatively, the colored areas 82*a*, 82*b* may be painted or be an otherwise colored area of the head body 10. The two colored areas 82*a*, 82*b* aid the alignment of the stroke 28.

In summary, the present sighting system consists primarily of the stepped surfaces 46 and a directional line 44 running from the back 62 toward the club face 14 of the club head H forming a "T." The stepped surfaces 46 of the first sighting indicia 42 align the club face 14 of the club head H and the line of direction 28 or path the ball B will go. The bands 48 and stepped surfaces 46 help visually to promote the effectiveness in that the golfer's 58 head is tilted somewhat when putting or striking the golf ball B.

The foregoing disclosure and description of the invention are illustrative and explanatory thereof and various changes in the size, shape and materials, as well as in the details of the illustrated construction may be made without departing from the spirit of the invention.

I claim:

1. A golf club head having a head body adapted to be secured to a club shaft and comprising:

a first vertically oriented surface defining a ball striking face containing a sweet spot thereon and a cavity formed in a backside of the club head;

a first sighting indicia comprising a series of stepped surfaces and one supporting bands connecting pairs of separate levels of the stepped surfaces, the stepped surfaces each having an elongated longitudinal axis extending parallel to the first vertically oriented surface;

a second sighting indicia formed on a bottom surface of said cavity and comprising an elongated slender stripe having a longitudinal axis perpendicular to the elongated longitudinal axis of the stepped surfaces and intersecting the sweet spot of the first vertically oriented surface; and, the first sighting indicia being located between the first vertically oriented surface and the second sighting indicia;

whereby the first and second sighting indicia enable a user of the club to visually align the sweet spot of the first vertically oriented surface relative to a golfball to be struck and a desired direction of travel for the golfball.

2. The invention of claim 1 wherein the second sighting indicia is a groove formed in the backside of the club head.

3. The invention of claim 1 wherein the second sighting indicia has a color different from a surrounding portion of the club head.

4. The invention of claim 1 wherein the series of stepped surfaces descend in levels from an upper edge of the first vertically oriented surface toward the backside of the club head.

5. The invention of claim 4 wherein the first sighting indicia extends only a portion of the backside of the club head.

6. The invention of claim 1 further including at least one mass member in the club head extending behind the first vertically oriented surface and having a portion visible on an upper surface of the club head.

* * * * *